US008424888B2

(12) United States Patent
Ahuja et al.

(10) Patent No.: US 8,424,888 B2
(45) Date of Patent: Apr. 23, 2013

(54) SYSTEMS AND METHODS FOR WEIGHT TRANSFER IN A VEHICLE

(75) Inventors: Munishwar Ahuja, Bangalore (IN); Nikhil Subhashchandra Tambe, Bangalore (IN); Amit Kalyani, Bangalore (IN); Ravi Kumar, Tumkur (IN)

(73) Assignee: General Electric Company, Niskayuna, NY (US)

( * ) Notice: Subject to any disclaimer, the term of this patent is extended or adjusted under 35 U.S.C. 154(b) by 101 days.

(21) Appl. No.: 12/869,527

(22) Filed: Aug. 26, 2010

(65) Prior Publication Data

US 2012/0049481 A1 Mar. 1, 2012

(51) Int. Cl.
*B62D 61/12* (2006.01)
*B60G 17/016* (2006.01)
*B60G 17/018* (2006.01)

(52) U.S. Cl.
USPC ..... 280/86.5; 280/6.159; 280/5.514; 280/124.151; 280/124.164; 180/209

(58) Field of Classification Search ..... 180/209, 180/41, 22; 280/86.5, 5.514, 5.52, 6.15, 280/6.159, 6.157, 124.101, 124.151, 124.158, 280/124.164, 124.165
See application file for complete search history.

(56) References Cited

U.S. PATENT DOCUMENTS

| | | | | |
|---|---|---|---|---|
| 1,585,833 | A * | 5/1926 | Down | 303/22.8 |
| 3,166,340 | A * | 1/1965 | Rusconi | 280/104 |
| 3,850,437 | A * | 11/1974 | Owen | 280/6.157 |
| 4,075,950 | A | 2/1978 | Marta | |
| 4,735,149 | A | 4/1988 | Scheffel et al. | |
| 4,981,309 | A * | 1/1991 | Froeschle et al. | 280/6.157 |
| 5,244,190 | A * | 9/1993 | Bianchi | 267/195 |
| 6,036,206 | A * | 3/2000 | Bastin et al. | 280/124.1 |
| 6,997,464 | B2 * | 2/2006 | Yakimishyn | 280/6.159 |
| 8,002,065 | B2 * | 8/2011 | Glavinic et al. | 180/209 |
| 2003/0155164 | A1 * | 8/2003 | Mantini et al. | 180/209 |
| 2009/0072460 | A1 * | 3/2009 | Michel | 267/225 |
| 2009/0184480 | A1 * | 7/2009 | Larsson et al. | 280/5.503 |

FOREIGN PATENT DOCUMENTS

GB 191552 A 1/1923

* cited by examiner

*Primary Examiner* — Drew Brown
(74) *Attorney, Agent, or Firm* — Marie-Claire B. Maple

(57) ABSTRACT

Systems and methods for weight transfer in a vehicle are provided. One system includes a plurality of springs and a plurality of movable spring seats configured to adjust a length of the plurality of springs. Additionally, an electromechanical actuator is provide that is connected to the plurality of movable springs and configured to move the movable spring seats to adjust the length of the plurality of springs. Further, a controller is provided that is coupled to the electromechanical actuator to control the electromechanical actuator to adjust the length of the plurality of springs.

20 Claims, 10 Drawing Sheets

SYSTEMS AND METHODS FOR WEIGHT TRANSFER IN A VEHICLE

BACKGROUND OF THE INVENTION

Vehicles, such as diesel-electric locomotives, may be configured with truck assemblies including two trucks per assembly, and three axles per truck, for example. The three axles may include at least one powered axle and at least one non-powered axle. The axles may be mounted to the truck via lift mechanisms, such as suspension assemblies including one or more springs, for adjusting a distribution of locomotive weight (including a locomotive body weight and a locomotive truck weight) between the axles.

As the vehicle travels along the rails, the amount of load on each of the axles of the truck can vary, with each axle also having a maximum load weight. In certain conditions, such as during inclement weather, proper traction with the track may be lost, thereby resulting in one or more wheels slipping. Accordingly, the tractive effort for these vehicles may be less than optimized. For example, the tractive effort may be affected on trains, particularly for heavy trains or hauls, during start-up, on inclines, and during adverse rail conditions, such as caused by inclement weather or other environmental conditions.

In known rail vehicle systems, the springs of the suspension systems for the trucks are preloaded. For example, each of the springs is preloaded based on a normal amount of weight to be supported by the suspension system for the axles. As a result, under certain conditions, the preloaded springs may not provide the sufficient normal force to maintain proper contact between the wheels of the truck and the track, especially during inclement or adverse rail conditions.

BRIEF DESCRIPTION OF THE INVENTION

In accordance with various embodiments, systems and method for weight transfer in a vehicle are provided. One embodiment includes a plurality of springs and a plurality of movable spring seats configured to adjust a length of the plurality of springs. Additionally, an electromechanical actuator is provide that is connected to the plurality of movable springs and configured to move the movable spring seats to adjust the length of the plurality of springs. Further, a controller is provided that is coupled to the electromechanical actuator to control the electromechanical actuator to adjust the length of the plurality of springs.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
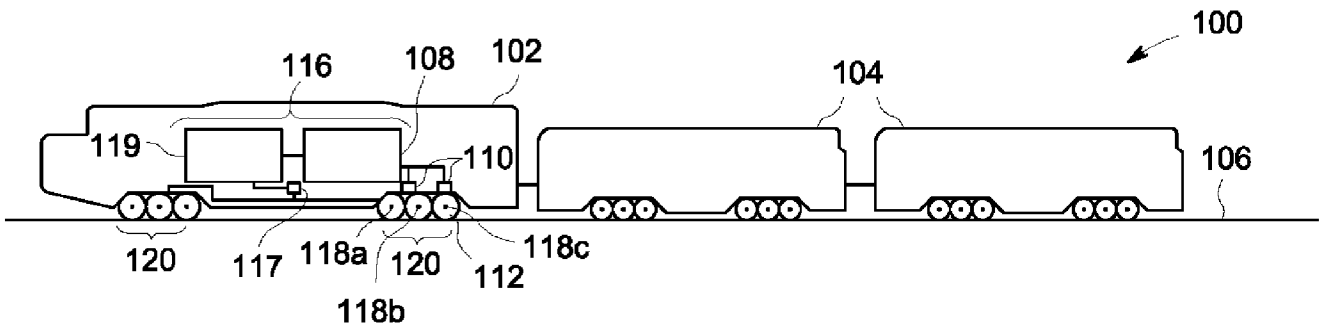
FIG. 1 is a diagram of a vehicle formed in accordance with one embodiment.

To the extent that the figures illustrate diagrams of the functional blocks of various embodiments, the functional blocks are not necessarily indicative of the division components. Thus, for example, one or more of the functional blocks may be implemented in a single piece of hardware or multiple pieces of hardware. It should be understood that the various embodiments are not limited to the arrangements and instrumentality shown in the drawings.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It should be noted that although one or more embodiments may be described in connection with powered rail vehicle systems having locomotives with trailing passenger or cargo cars, the embodiments described herein are not limited to trains. In particular, one or more embodiments may be implemented in connection with different types of vehicles including wheeled vehicles, other rail vehicles, and track vehicles.

Example embodiments of one or more apparatus and methods for changing the load of the axles to redistribute the load on the axles of a truck in a vehicle are provided. As described below, one or more of these embodiments provide dynamic weight transfer among the axles, for example, to redistribute the load to provide more load on the powered axles. By practicing the various embodiments, and at least one technical effect is increased traction on the powered axles, which may facilitate the tractive effort during certain traction limited modes of operation. Moreover, by practicing the various embodiments, less traction motors may be used to generate the same amount of tractive force or effort. For example, on a six axle truck, traction motors may be provided on only four of the axles instead of all six axles.

FIG. 1 is a diagram of a powered rail vehicle 100 formed in accordance with one embodiment, illustrated as a locomotive system. While one embodiment of the presently described subject matter is set forth in terms of a powered rail vehicle, alternatively the subject matter may be used with another type of vehicle as described herein and noted above. The rail vehicle 100 includes a lead powered unit 102 coupled with several trailing units 104 that travel along one or more rails 106. In one embodiment, the lead powered unit 102 is a locomotive disposed at the front end of the rail vehicle 100 and the trailing units 104 are cargo cars for carrying passengers and/or other cargo. The lead powered unit 102 includes an engine system, for example, a diesel engine system 116. The diesel engine system 116 powers traction motors 110 coupled with wheels 112 of the rail vehicle 100 that provides tractive effort to propel the rail vehicle 100. For example, the diesel engine 108 may rotate a shaft that is coupled with an alternator or generator (not shown). The alternator or generator creates electric current based on rotation of the shaft. The electric current is supplied to the traction motors 110, which turn the wheels 112 and propel the rail vehicle 100. It should be noted that for simplicity and ease of illustration, the traction motors 110 are only shown in connection with one set of wheels 112. However, traction motors 110 may be provided in connection with other wheels 112 or sets of wheels 112 as described herein.

Figure 2:
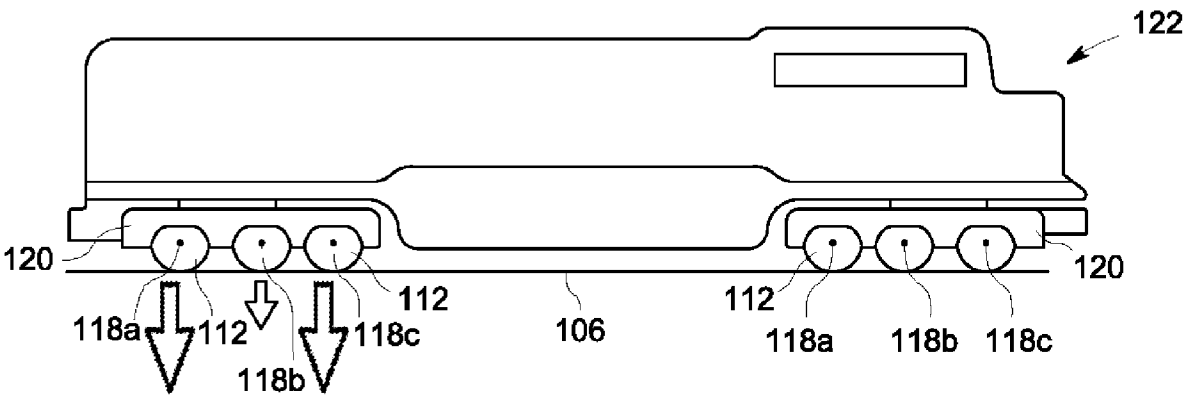
FIG. 2 is a side view of a vehicle having trucks with variable spring preloaded suspensions in accordance with various embodiments.
Figure 3:
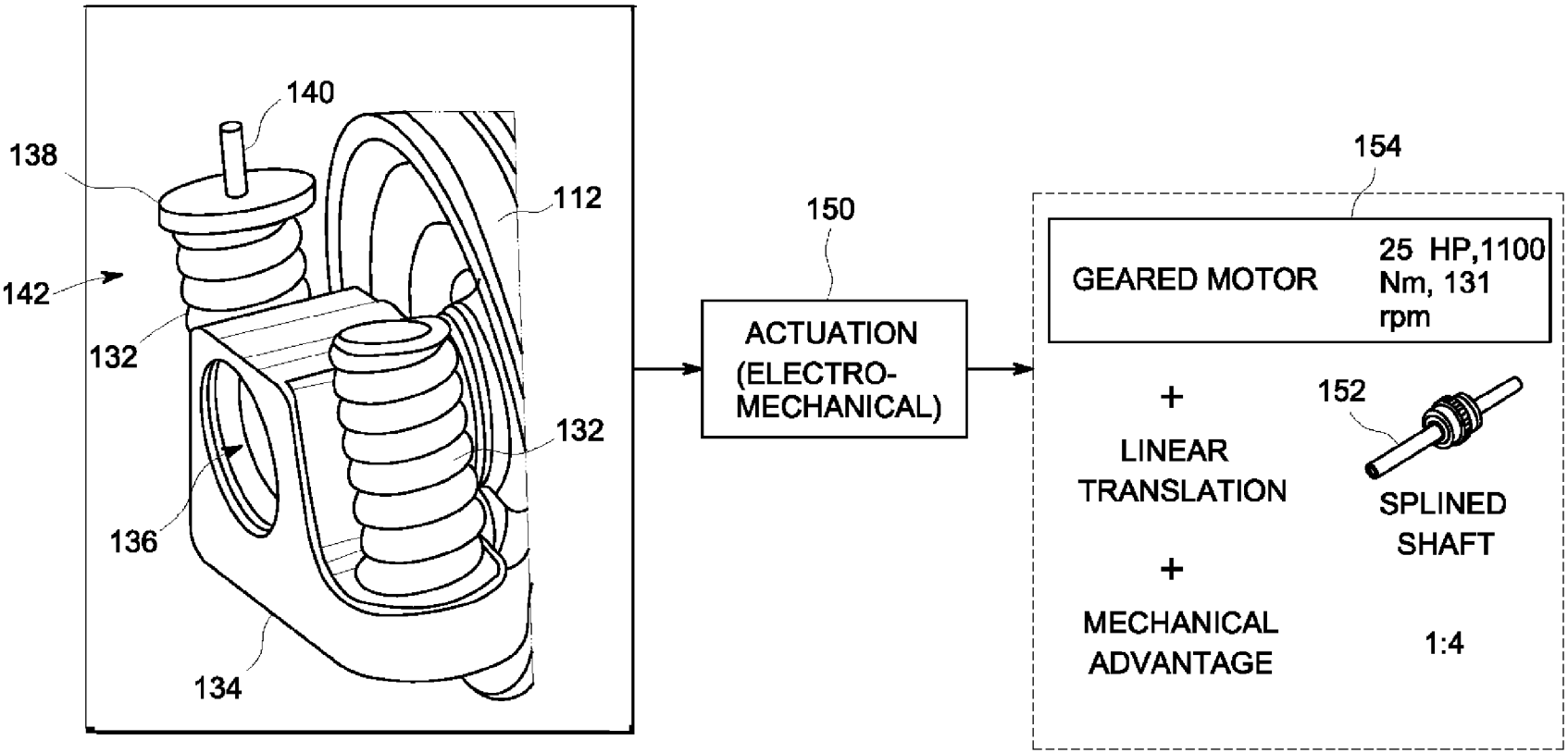
FIG. 3 is a diagram of a spring preloading mechanism with actuation in accordance with various embodiments.

The rail vehicle 100 includes a controller, such as a control module 114 that is communicatively coupled with the traction motors 110 and/or an actuator 117 for controlling the load on springs 132 of a suspension system 142 (both shown in FIG. 3). For example, the control module 114 may be coupled with the traction motors 110 and/or the actuator 117 by one or more wired and/or wireless connections. The control module 114 operates in some embodiments to control and redistribute the load supported by the each of the wheels 112, and more particularly, each axle 118. In various embodiments, dynamic load distribution may be independently provided to each of the axles 118. For example, each of the units 102 and 104 may include two sets of wheels 112 corresponding to two trucks 120 (shown more clearly in FIG. 2). As illustrated, each truck 120 includes three axles 118, with each having two wheels 112. In some embodiments, the outer axles 118*a* and 118*c* are powered by a traction motor 110, with the inner axle 118*b* not powered by a traction motor 110. Accordingly, for a particular unit 102 or 104, traction motors 110 are provided in connection with a total of four axles 118 instead of all six axles 118. It should be noted that the number of traction motors 110 and which axles 118 are connected to the traction motor 110 may be modified such that different configurations of tractive power may be provided.

The control module 114 may include a processor, such as a computer processor, controller, microcontroller, or other type of logic device, that operates based on sets of instructions stored on a tangible and non-transitory computer readable storage medium. The computer readable storage medium m may be an electrically erasable programmable read only memory (EEPROM), simple read only memory (ROM), programmable read only memory (PROM), erasable programmable read only memory (EPROM), FLASH memory, a hard drive, or other type of computer memory.

Thus, as illustrated by the locomotive 122 shown in FIG. 2, weight transfer or redistribution may be provided, such as when the wheels 112 are slipping relative to the rails (e.g., track) 106. In accordance with various embodiments, weight redistribution is provided, such that weight from the inner or middle axle 118*b* is redistributed to the outer axles 118*a* and 118*c*, illustrated by the larger arrows corresponding to the outer axles 118*a* and 118*c* and the smaller arrow corresponding to the inner axle 118, which represents a change in the weight or load on each of the axles 118*a-c*. The increased weight on the outer axles 118*a* and 118*c* results in increased traction of the wheels 112 of the axles 118*a* and 118*c* with the rails (e.g., track) 106, which reduces the amount of wheel slip, such as during traction limited modes of operation. Thus, the control module 114 may provide dynamic weight redistribution among the axles 118*a-c*. It should be noted that weight redistribution may be provided in connection with any unit of the rail vehicle system.

The weight redistribution in some embodiments includes a transfer of the weight from the inner axle 118*b* equally to the outer axles 118*a* and 118*c*. The weight redistribution is provided by changing the preload of springs in connection with the each of the axles 118*a-c*. For example, in some embodiments, four springs are provided per axle 118*a-c*. However, the redistribution of weight is achieved by changing the preload of some, but not all of the springs.

Various embodiments redistribute weight among the axles 118*a-c* by changing a spring length, for example, a working spring length. Thus, a preload on the spring is changed such that variable spring displacement is provided. For example, in one embodiment as illustrated in FIG. 3, a variable spring preload arrangement 130 is illustrated forming part of a suspension system 142. It should be noted that like numbers represent like parts in the Figures. The variable spring preload arrangement 130 includes a mechanism for changing a preload of one or more springs 132 of the suspension system 142 of a truck 120 (shown in FIG. 2), a portion of which is shown in FIG. 3. An axle box 134 (which also may be referred to as a journal box) is provided having an opening 136 therethrough for receiving an axle, such as the axle 118*a-c* of the locomotive 122 (both shown in FIG. 2) extending also through the wheel 112. In the illustrated embodiment, two springs 132 are provided in connection with each axle side.

In one embodiment, as shown in FIG. 3, the mechanism for changing the preload of the springs 132 and thereby adjusting the working length of the springs 132 is a spring seat 138. It should be noted that although the spring seat 138 is shown at a top end of the springs 132, the spring seat 138 may be located on a bottom end of the springs 132. In the illustrated embodiment, the bottom or lower end of the spring is supported on the axle box 134 using, for example, a spring cap as described in more detail herein. Thus, the variable spring preload arrangement 130 includes a mechanism wherein a top end of the springs 132 is movable to provide the adjustable preloading and the bottom end of the springs 132 is fixed against the axle box 134.

In FIG. 3, one of the springs 132 (the right side spring 132) is shown without the spring seat 138 attached. The spring seat 138 may include a coupling end 140 to allow controllable actuation of the variable spring preload arrangement 130, such as by the control module 114 (shown in FIG. 1). The controllable actuation in various embodiments is provided using an electromechanical actuation system 150 as described in more detail below. The electromechanical actuation system 150 may be implemented in different configurations and arrangements, as well as positioned at different locations of the truck. As one example, a splined shaft 152 may be provided in connection with a geared motor 154, which translates rotational movement of the motor 154 to linear movement of the spring seat 138. Thus, a mechanical advantage is provided wherein linear translation of rotational movement causes a change in the preloading of the springs 132. Moreover, a mechanical advantage may be provided using different configurations of the actuation mechanism, for example, using a lever mechanism as described in more detail herein. For example, in some embodiments, a mechanical advantage of 1:4 is provided, which is in addition to any mechanical advantage provided by the gear ratio of the geared motor 154. However, it should be noted that different ratios of mechanical advantage may be provided depending on the configuration or arrangement Thus, the gear provide an initial mechanical advantage and the lever provides an advantage once the rotational motion is converted to translational motion.

Thus, the preload and effective pre-compression of the springs 132 may be dynamically adjusted, which affects the working length of the springs 132 and the load on the axle 118. In some embodiments, changing of the preloading of the springs 132 may be initiated based on a user input, for example, based on a user identifying a traction limited mode of operation (e.g., wheel slipping or upcoming rail incline or adverse rail condition). In other embodiments, the changing of the preloading of the springs 132 may be initiated automatically, for example, based on a sensed or detected traction limited modes of operation using one or more sensor. In these embodiments, upon detecting the traction limited mode of operation or an upcoming traction limited mode of operation, such as based on an identification of the traction limited mode of operation by the sensor, which is communicated to the control module 114, the control module 114 automatically changes the preloading of the springs 132. A notification of the automatic preloading change may be provided to an operator, such as via an audible and/or visual indicator.

Figure 4:
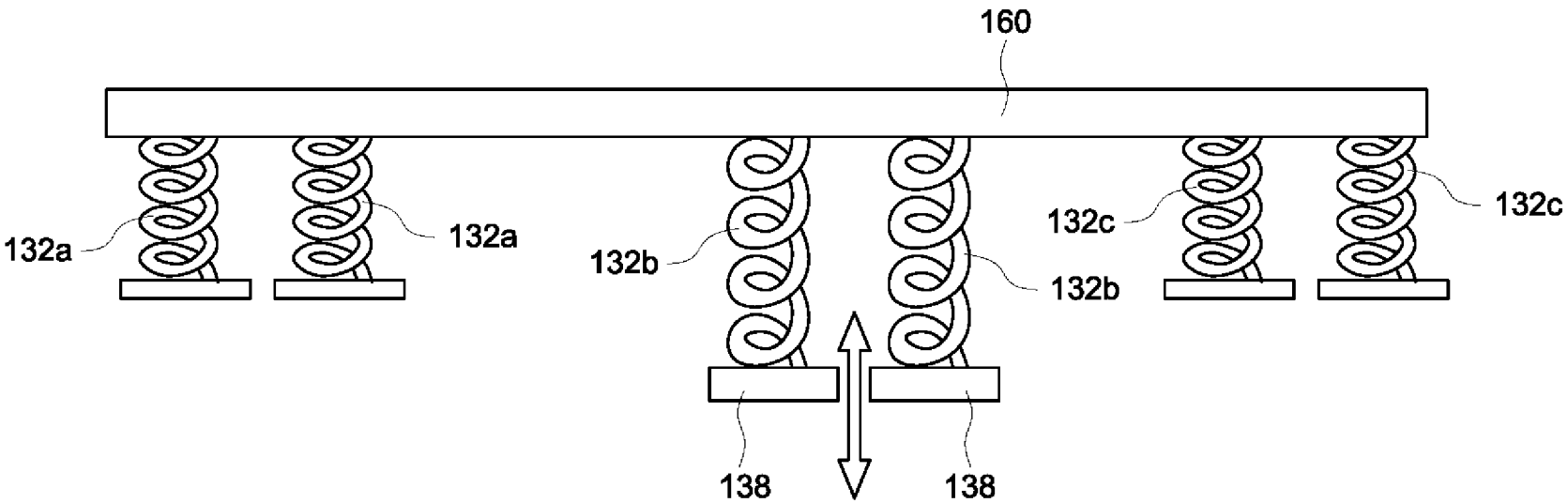
FIG. 4 is a schematic block diagram of a variable spring preload arrangement in accordance with one embodiment.

In the various embodiments, the control module 114 instructs the electromechanical actuation system 150 to change the preloading of the springs 132, for example, by operating the motor 154 to linearly translate the spring seat 138. The translation of the spring seat 138 that changes the preloading and working length of the springs 132 redistributes the load among the axles 118 (shown in FIGS. 1 and 2). For example, the electromechanical actuation system 150 may cause the spring seats 138 to move vertically downward to compress the springs 132 to shorten the working length of the springs 132 or move vertically upward to lengthen the working length of the springs 132 as illustrated in FIG. 4. For example, if the spring seats 138 are moved vertically upward, the working length of the springs 132 is increased or lengthened, which reduces the preloading of the springs 132. The reduction in the preloading of the springs 132 causes shift in the weight among the axels 118, namely to the other axles 118.

More particularly, referring to the example in FIG. 4, showing a portion of a truck frame 160, if the preloading of the springs 132 of the center axle 118*b* is reduced by lengthening the springs 132, the weight or load is transferred or redistributed from the center axle 118*b* to the outer axles 118*a* and 118*c* (all of the outer axles 118*a-c* are shown in FIGS. 1 and 2). The outer springs 132*a* and 132*c* correspond to the outer axles 118*a* and 118*c* and the inner springs 132*b* correspond to the inner axles 118*b*. The weight redistribution is equal when the change in spring preloading is the same. Accordingly, weight redistribution is provided by moving the spring seats 138 to change the preloading of the springs 132. It should be noted that in this embodiment, the spring seat 138 is illustrated at the bottom end of the springs 132. Also, in the illustrated embodiment, the spring seats 138 are shown on the springs 132*b* and not the other springs 132*a* and 132*b*. However, the spring seats 138 and consequently the control of the preloading may also be provided to the other springs 132*a* and/or 132*b*.

The spring seats 138 may be any suitable device for engaging and abutting an end of the springs 132 for translating the springs 132. For example, the spring seats 138 may be a washer or other end support for the springs 132, such as a support plate. Additionally, the springs 132 may be any type of spring, such as any spring suitable for a locomotive suspension.

In an initial state of preloading, such as when a traction limited mode of operation is not detected, all of the springs 132*a*, 132*b* and 132*c* are preloaded the same. Thus, all of the springs 132*a*, 132*b* and 132*c* have the same or about the same working length. As the working length of the center springs 132*b*, which is an effective length of the springs, is increased, the net preload on the inner axle 118*b* (center axle) changes and the load or weight is redistributed to the outer axles 118*a* and 118*c*.

As an example, if the rated load of each of the three axles 118*a*, 118*b* and 118*c* is 70,000 pounds (also referred to as 70,000 pounds-force (lbf), the axles 118*a*, 118*b* and 118*c* may be precompressed to have the same preloading. In this state, the working length of the springs 132*a*, 132*b* and 132*c* may be about 20.5 inches. In such an embodiment, the limits of the springs 132*a*, 132*b* and 132*c* defined by the solid length and the free length of the springs 132*a*, 132*b* and 132*c* may be about 17 inches to about 25 inches. By changing the compression of one or more of the springs, such as the inner springs 132*b* (also referred to as the center springs), the load on all of the axles 118*a*, 118*b* and 118*c* is redistributed. For example, if the length of the inner springs 132*b* is increased by about 1.5 inches, approximately 40,000 lbf is transferred about equally from the inner axle 118*b* (also referred to as the center axle) to the outer axles 118*a* and 118*c*. Thus, the inner axle 118*b* supports a load of 30,000 lbf, while each of the outer axles 118*a* and 118*c*, to which the extra load of 40,000 lbf has been redistributed about equally, now supports 90,000 lbf each, thereby increasing the traction of the wheels 112 (shown in FIGS. 1 and 2) of the outer axles 118*a* and 118*c*.

The electromechanical actuation system 150 may be implemented in different configurations and arrangements. In some embodiments, the electromechanical actuation system 150 converts rotational movement into translational or linear movement to change the preloading of springs to redistribute the load among the axles 118. It should be noted that other actuation methods may be used. For example, the actuator may be one or more of a linear actuator, a pneumatic actuator, a hydraulic actuator, an electric actuator, an electro-magnetic actuator, a high pressure gas actuator, a mechanical actuator, and the like, that provides spring seat displacement.

In general, the various embodiments provide spring seat displacement using the electromechanical actuation system 150. For example, the electromechanical actuation system 150 may cause movement, such as vertical movement of the spring seat 138, which may be located at a top or bottom of the springs 132. As illustrated in FIGS. 5 through 8, the movable end of the spring 132 is the lower end with the upper end of the spring 132 being fixed. For example, the electromechanical actuation system 150 may include an actuator 170 that operates using a lower lifting mechanism to change the length of the springs 132 (only one spring is shown). In this embodiment, the actuator 170 is shown mounted to the axle box 134. However, in other embodiments, the actuator 170 may be mounted to other portions of the locomotive, for example, to the truck frame. In various embodiments, the actuator 170 is only mounted to one of the axles 118, in particular the inner axles 118*b* (shown in FIGS. 1 and 2). However, the actuator 170 may be provided on different axles, for example, each of the outer axles 118*a* and 118*c* may include the actuator 170 and the inner axle 118*b* does not include an actuator 170.

Figure 5:
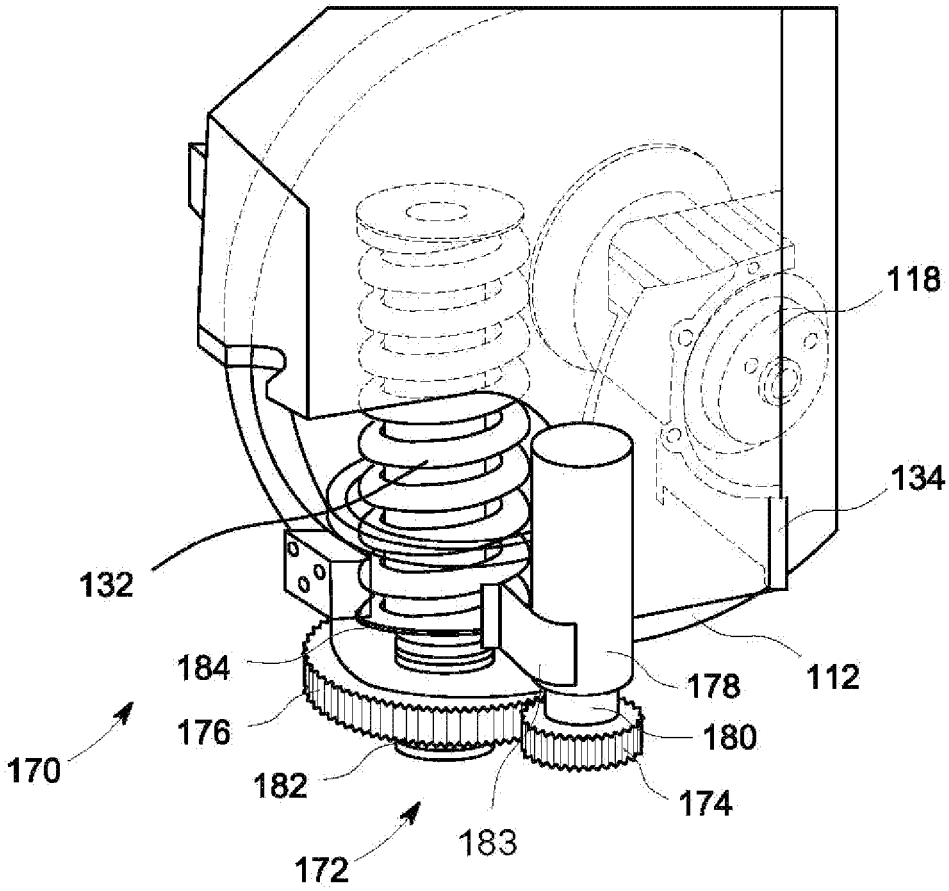
FIG. 5 is a perspective view of an actuator formed in accordance with one embodiment.
Figure 6:
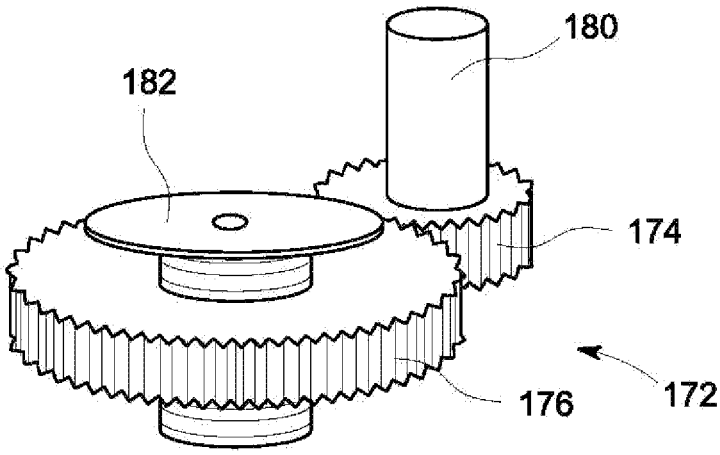
FIG. 6 is a perspective view of a gearing arrangement of the actuator of FIG. 5.

The actuator 170 includes a gearing arrangement 172, illustrated as a gear pair having a pinion 174 and a gear 176 as shown more clearly in FIG. 6. The pinion 174 and gear 176 are illustrated as toothed wheels, however, other types of gearing arrangements and components may be provided. For example, a sprocket or pulley arrangement may alternatively be provided. In the illustrated embodiment, the gearing arrangement 172 is a step-down arrangement such that an increased mechanical advantage is provided. Accordingly, the pinion 174, which is coupled to a motor 178 via a motor shaft 180 (or other coupling device), has a smaller diameter than the gear 176, which is coupled to a power screw 182. The motor 178 is mounted to the axle box 134 using a fastener 183, for example, a clamp or clip. It should be noted that various components in FIG. 5 are shown as transparent merely to illustrate the other components of the actuator 170.

Figure 7:
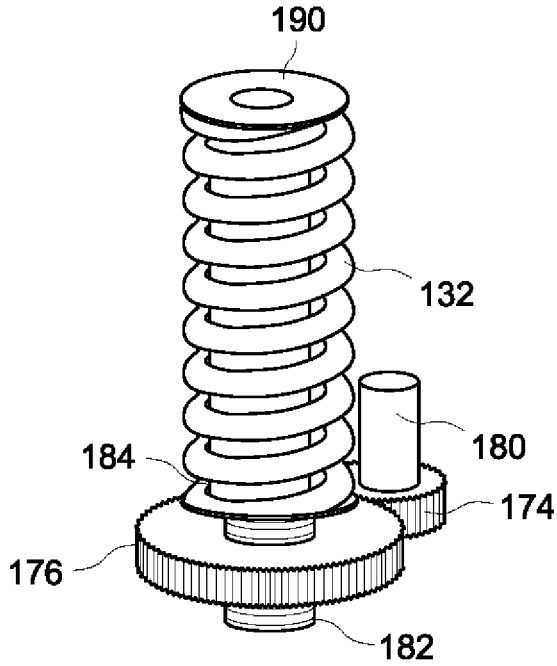
FIG. 7 is a perspective view of a spring seat arrangement of the actuator of FIG. 5.
Figure 8:
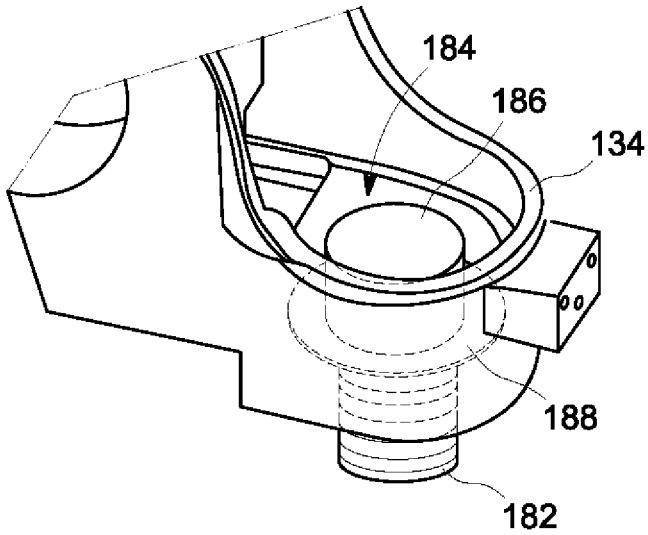
FIG. 8 is a perspective view of a spring cap and power screw of the actuator of FIG. 5.

As illustrated in FIGS. 7 and 8, the power screw 182 extends through the axle box 134, such as through a threaded opening and having a spring cap 184 mounted thereon. The spring cap 184 is adapted to receive a lower end of the spring 132 such that rotation of the power screw 182 causes linear movement of the spring cap 184, thereby moving the spring 132 linearly, namely translating the spring 132. It should be noted that the spring cap 184 may be any device capable of engaging or supporting the spring 132 to allow movement of the spring 132 to shorten or lengthen the spring 132. The illustrated spring cap 184 includes an insert 186 having a flange extending radially outward from the insert 186. The insert 186 is configured to be received within the spring 132 as shown in FIGS. 5 and 7. A non-moving spring seat 190 is also provided on the top end of the spring 132 to prevent movement of the top end, such that the length of the spring 132 is changed by moving the spring seat 132 at the bottom end of the spring 132. Alternatively, if the location of the non-moving spring seat 190 and spring seat 138 are switched, the upper end of the spring 132 moves with the bottom end fixed.

In operation, the motor shaft 180 is driven by the motor 178, which may be an electric motor, and causes rotation of the pinion 174. The rotation of the pinion 174 causes rotation of the gear 176, thereby rotating the power screw 182. It should be noted that the power screw 182 may be any type of screw capable of being driven by a motor and/or gearing arrangement such that rotational motion is converted to translational or linear motion. Thus, as the power screw 182 rotates, the spring cap 184 is moved upward or downward, thereby causing movement of the spring 132 that is positioned between the spring cap 184 and the non-moving spring seat 190. Accordingly, rotational movement of the power screw 182 causes translational movement of the spring cap 184 to change the length of the spring 132 as described in more detail herein.

Figure 9:
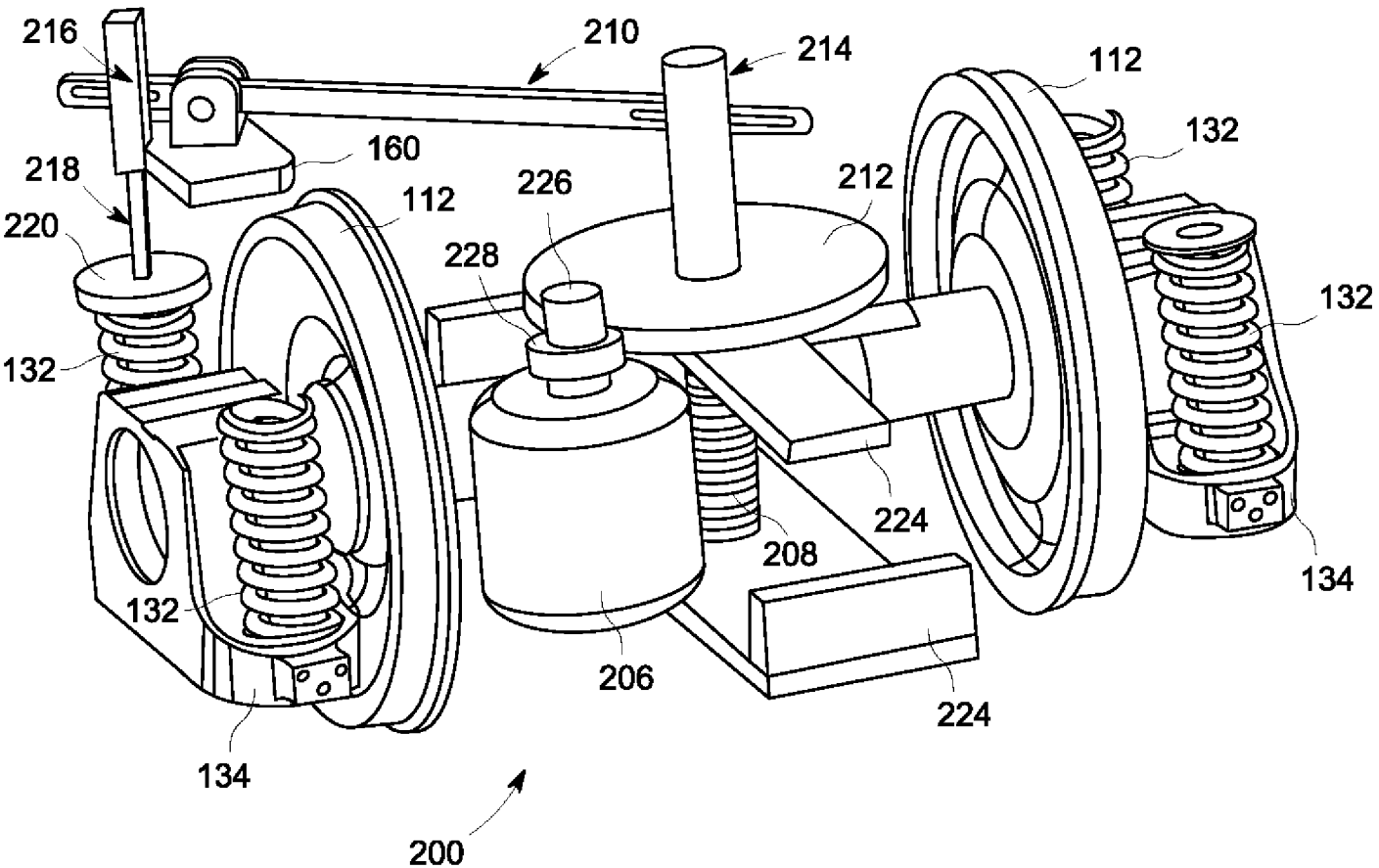
FIG. 9 is a perspective view of an actuator formed in accordance with various embodiments.
Figure 10:
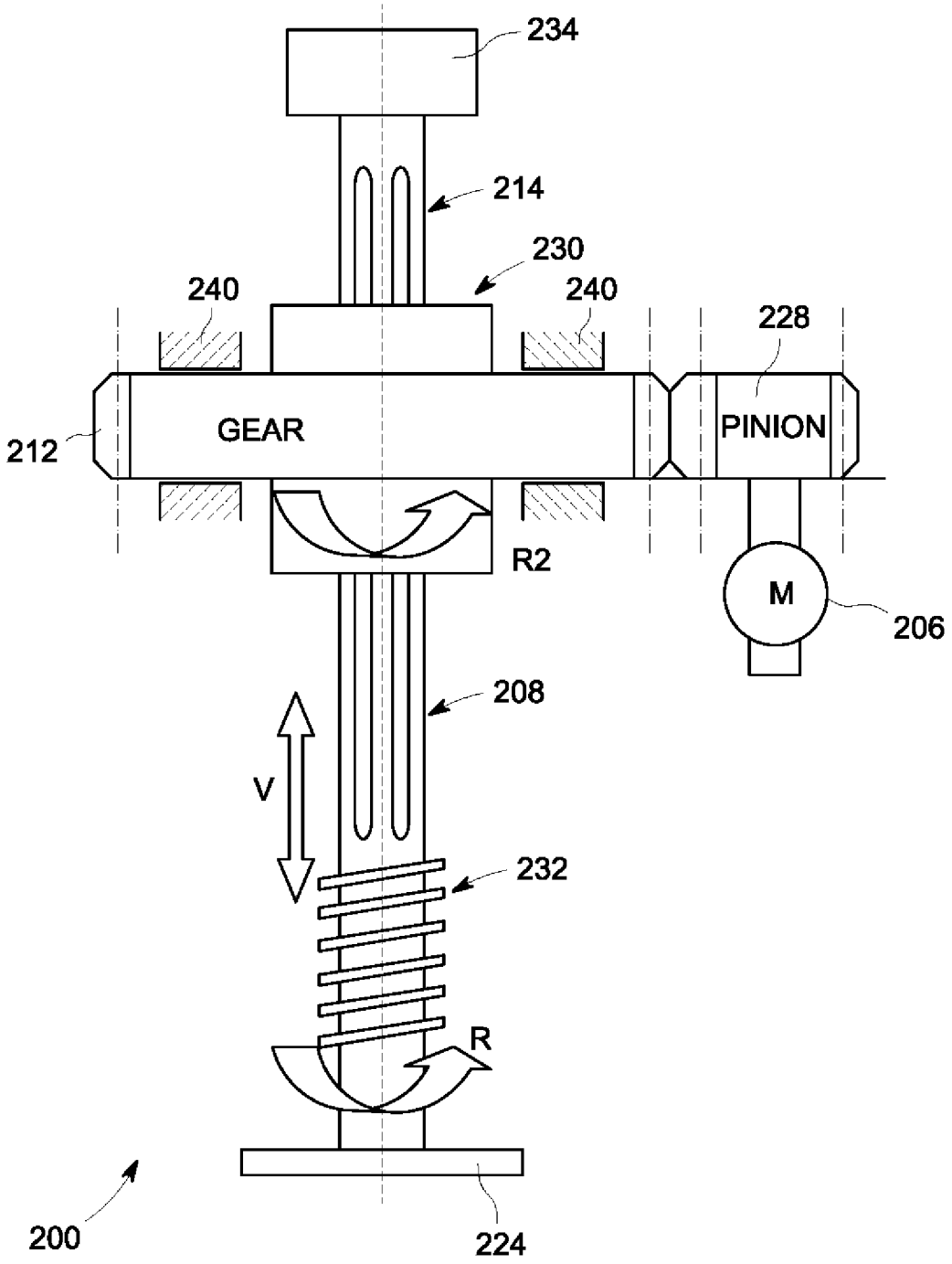
FIG. 10 is a schematic block diagram of a power screw arrangement of the actuator of FIG. 9.
Figure 11:
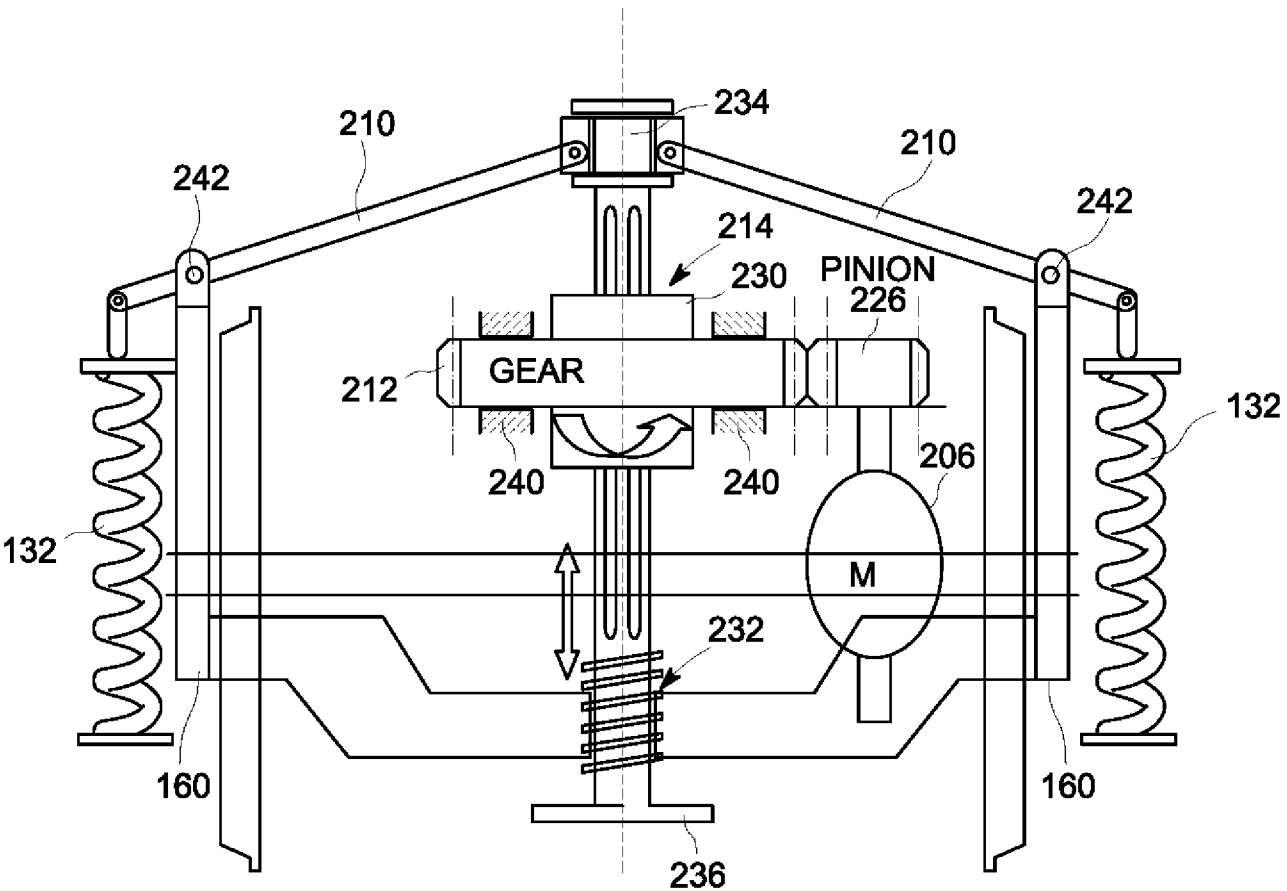
FIG. 11 is a schematic block diagram of the actuator shown in FIG. 9.
Figure 12:
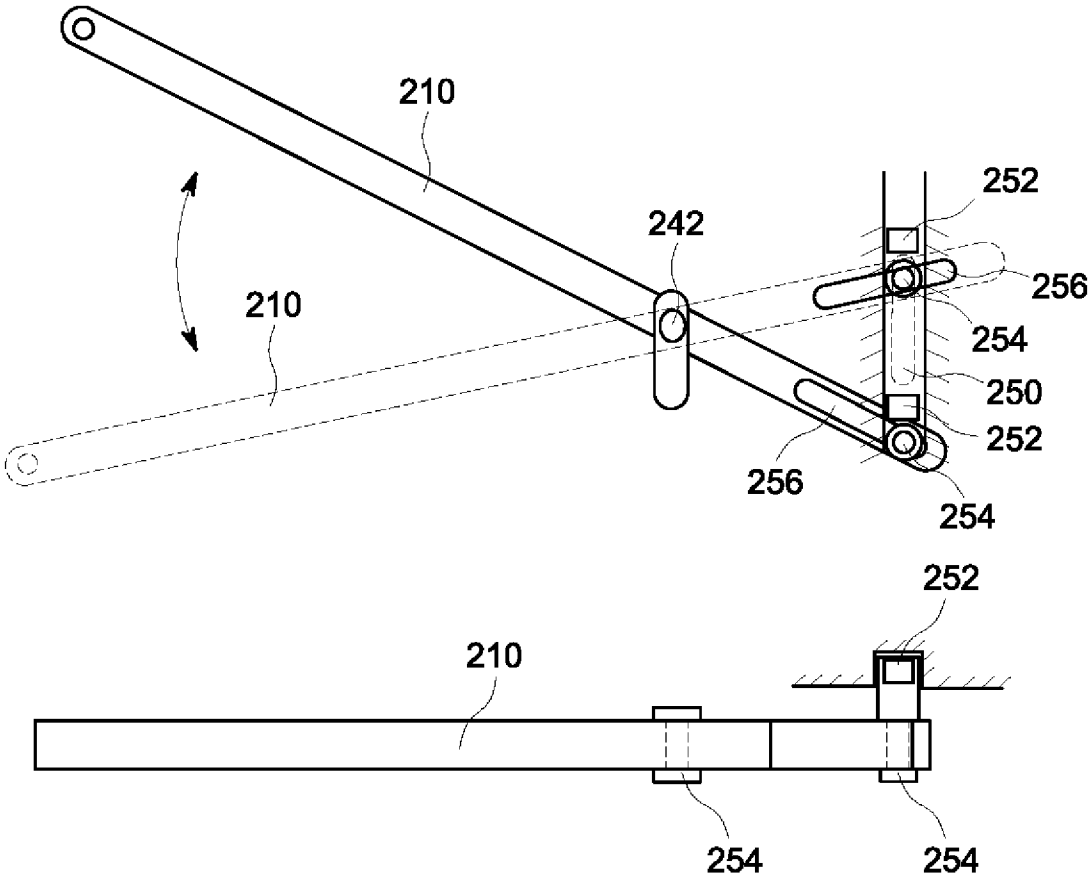
FIG. 12 is a schematic block diagram of a guiding and locking mechanism of the actuator shown in FIG. 9.

As another example, which is illustrated in FIGS. 9 through 12, the movable end of the spring 132 is the upper end with the lower end of the spring 132 being fixed. In particular, as shown in FIGS. 9 through 11, an actuator 200 is mounted within the truck frame 160 (shown in FIG. 11). In some embodiments, the actuator 200 is coupled to an axle 118 of a vehicle having a pair of wheels 112. The actuator 200 is mounted within an opening in a middle portion of the truck frame 160, namely in connection with a center or inner axle 118*b* between outer axles 118*a* and 118*c* (all shown in FIGS. 1 and 2). In this embodiment, a traction motor 110 (shown in FIGS. 1 and 2) is coupled to each of the outer axles 118*a* and 118*c*, but not the inner axle 118*b* having the actuator 200. The traction motors 110 drive the vehicle as described in more detail herein, which may be coupled to the axles 118*a* and 118*c* with gearing arrangements. It should be appreciated that the truck frame 160 may be provided in any suitable manner to support and move a vehicle such that the variable spring preloading of various embodiments may be implemented in connection therewith.

In general, and as shown in FIG. 9, the actuator 200 includes a motor 206 that drives a power screw 208, causing movement of an actuating beam 210 (e.g., an actuating arm) via a gear 212 engaged with a pinion 228 mounted on a motor shaft 226. The actuating beam 210 causes linear movement of the spring 132 to change a length of the spring 132. It should be noted that for simplicity and ease of illustration the actuator 200 is shown coupled to only one spring 132 of the four springs connected to the axle 118. The actuator 200, however, is configured to change a length and preloading of all of the four springs 132. Thus, the described components for changing a length of one spring 132 may be used to change a length of any of the springs 132, for example, using four actuating beams 210.

As illustrated more clearly in FIGS. 9 through 12, the actuating beam 210 is connected to a guide and stopper arrangement 216, which is coupled to a plunger 218 having a spring seat 220 engaging a top of the spring 132 as described in more detail herein. The bottom of the spring 132 is supported by the axle box 134. It should be noted that additional support members 224 may be provided to support one or more of the components of the actuator 200 in the opening 204. In this embodiment, the support members 224 are configured as additional bridge supports.

In operation, and referring to FIGS. 9 through 12, the motor 206 drives the gear 212 using a pinion 228 that is smaller in diameter than the gear 212. The rotation of the motor shaft 226, and more particularly, rotation of the shaft with a spline 230 (e.g., ball spline) connected to the pinion 228 via the gear 212, results in axial vertical motion of the shaft 214 as a result of the movement of the threads 232 at the end of the power screw 208, which are at the end of the shaft 214. The shaft 214, which may be a spline shaft, includes a collar 234 (which connects to the actuating beam 210, two of which are shown in FIG. 14) at one end and the lower end of the power screw 208 at the other end of the shaft 214, engages a spring mounting platform 236.

The rotation of the power screw 208 illustrated by the arrow R1 causes rotation of the gear 212 (caused by the motor 206 and pinion 228) and vertical motion of the shaft 214 illustrated by the arrow V. The vertical motion of the shaft 214 actuates the actuating beam 210, and in particular, causes pivoting motion of the actuating beam 210. The pivoting actuating beam 210 causes the plunger 218 to move, for example, push or pull, such that the spring 132 is compressed or released. Once the desired or required actuation is complete, such as compressing or releasing the spring to decrease or increase, respectively, the length of the spring 132, the plunger 218 may be locked in position using any suitable locking mechanism. It should be noted that one or more thrust bearings 240 may be provided in connection with the gear 212.

Thus, the threads 232 on the end of the shaft 214 (forming the power screw 208) mates with threads on the frame structure, illustrated as the support member 224. Rotation of the power screw 208 results in linear motion of the shaft 214 relative to the truck frame 160, thereby varying the relative position of the spring 132 to the mounting platform 236. Accordingly, the power screw 208 translates or converts rotational movement into linear or translational movement. Thus, linear movement of the collar 234 causes the springs 132 to move up or down via pivot points 242. For example, as illustrated in FIG. 15, vertical guiding and locking may be provided such that the actuating beam 210 engages within a slot 250 having stoppers 252 (e.g., rubber blocks) at opposite ends of the slot 250 to limit the movement of the actuating beam 210. As the actuating beam 210 rotates, the slot 250 maintains the vertical motion of the end of the actuating beam 210 along one axis, which motion is limited when a bolt 254 within a slot 256 of the actuating beam 210 contacts one of the stoppers 252.

It should be noted that in the various embodiments, the gears are mounted using bearings (e.g., thrust or ball bearings), which are not necessarily illustrated in the Figures.

Thus, various embodiments provide variable spring preloading of a vehicle suspension system. The variable spring preloading causes load redistribution among the axles of the vehicle. For example, dynamic weight transfer may be provided from a center axle to outer axles in a locomotive truck.

Figure 13:
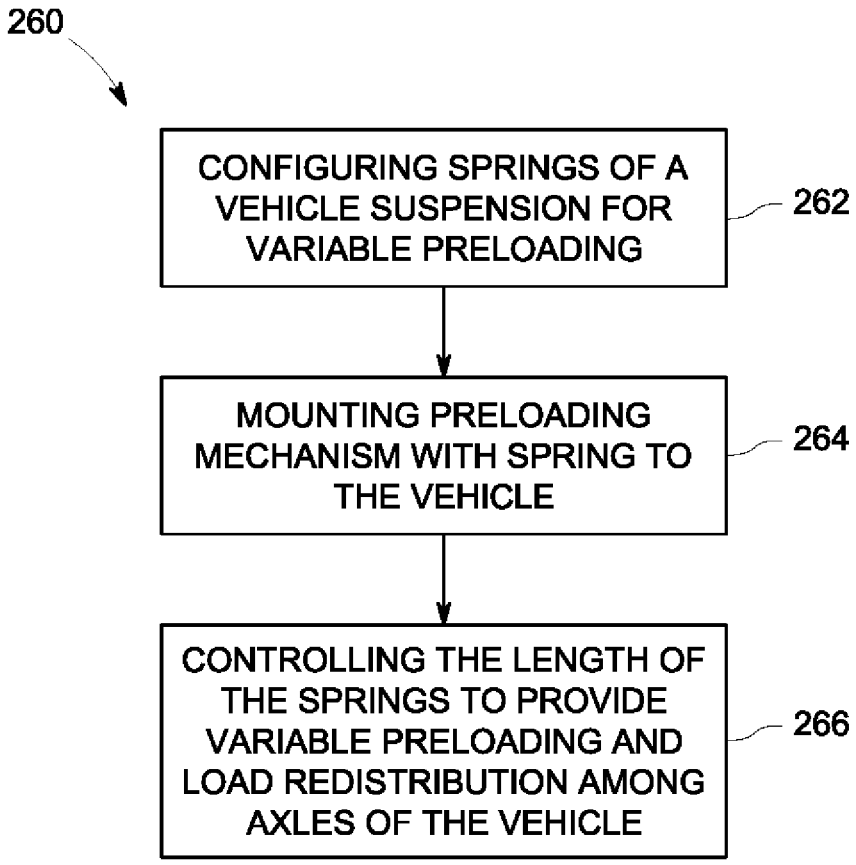
FIG. 13 is a flowchart of a method to dynamically redistribute weight in a vehicle in accordance with various embodiments.

A method 260 as shown in FIG. 13 also may be provided to dynamically redistribute weight in a vehicle. The method 260 includes configuring springs of a vehicle suspension for variable preloading at 262. For example, a mechanism for lengthening and shortening the springs, such as using a spring seat displacement described herein allows for variable preloading of the springs based on a variable compression applied by the spring seat.

The method 260 then includes mounting the preloading mechanism to the vehicle at 264. For example, springs having the preloading mechanism may be mounted to the vehicle or a portion thereof, such as the axle box. In some embodiments, the preloading mechanism is provided on springs of an inner axle and not on the outer axles of a three axle truck, with two trucks provided per vehicle.

With the preloading mechanism mounted with the springs, the length of the springs is controlled at 266 to provide variable preloading and load/weight redistribution among the axles of the vehicle. For example, by varying the length of one or more of the springs, the preloading of the spring is changed, which redistributes the load among the axles of the vehicle. The controlling may be provided using a control module that dynamically adjusts the length of the springs using an actuator, for example, an electromechanical actuator. The changes to the preloading may be based on different factors, such as traction limited modes of operation.

Various embodiments may dynamically control preloading of springs in a vehicle. For example, variable spring preloading may be provided on the center axle suspension (spring) pocket on the two trucks in a vehicle. The spring pocket is translated vertically within the axle box. A counter sunk cavity may replace the spring seat on the axle box. Alternatively, the spring pocket may translate on the truck side as well. The translation is affected by a power screw driven by a motorized drive through an appropriate gear reduction. With the translation of spring pocket, the effective preload on the spring can be varied. This varied preloading results in changing the overall load distribution on the three axles of the truck, leading to a distribution of the vehicle load to put more load on the powered outer axles. The higher load on the powered outer axles helps improve traction.

Thus, a counter sunk cavity may be machined in the axle box. The spring seat is mounted on a power screw that is mounted in this cavity in the axle box. The power screw is rotated with a geared motorized drive. The rotary motion is, thus, converted into translatory motion for the power screw, which in turn drives the spring seat and accordingly the spring up or down. The rotational motion can be controlled to provide the adequate translation for the spring seat.

Alternatively the spring may be configured to translate on the truck side with a similar mechanism. A single power screw with a motorized drive can be employed to translate all the four spring seats simultaneously through a lever mechanism.

In operation, and for example, the variable preloading redistributes the load on the three axles of a truck in a vehicle. The redistribution provides more load on the powered axles and may be used, for example, in locomotives that have six load carrying axles, but has traction motors on only four axles (the outer ones for each truck). The load redistribution enables more traction to be generated on the powered axles, such as during traction limited modes of operation for these locomotives. Thus, the locomotive may be driven with four traction motors.

The various embodiments may be implemented with no changes to the truck frame. For example, the motor and the variable spring preload mechanism can be mounted on the truck frame on either the inside or outside of the frame.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose several embodiments of the above subject matter, including the best mode, and also to enable any person skilled in the art to practice the embodiments of subject matter, including making and using any devices or systems and performing any incorporated methods. The patentable scope of the subject matter described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A vehicle suspension system, comprising:

a plurality of springs;

a plurality of movable spring seats configured to adjust a length of the plurality of springs; and an electromechanical actuator connected to the plurality of movable springs and configured to move the movable spring seats to adjust the length of the plurality of springs, wherein the electromechanical actuator comprises power screws configured to translate the plurality of movable spring seats;

a spring cap coupled to the power screws and forming the movable spring seats; and a controller coupled to the electromechanical actuator to control the electromechanical actuator to adjust the length of the plurality of springs.

2. The vehicle suspension system of claim 1, wherein the controller dynamically adjusts the length of the plurality of springs based on operating conditions.

3. The vehicle suspension system of claim 1, wherein the movable spring seats are positioned at one end of the plurality of springs with an opposite end of the plurality of springs being fixed.

4. The vehicle suspension system of claim 1, wherein the electromechanical actuator comprises a geared motor, and wherein the electromechanical actuator converts rotational movement of the geared motor to translational movement of the plurality of spring seats to linearly adjust a length of the plurality of springs.

5. The vehicle suspension system of claim 1, further comprising an axle box and wherein one end of the plurality of springs engages the plurality of movable spring seats and an opposite end engages the vehicle frame in a non-movable configuration.

6. The vehicle suspension system of claim 1, wherein the plurality of springs comprise outer axle springs and an inner axle springs, and wherein the plurality of movable spring seats are coupled only to the inner axle springs.

7. The vehicle suspension system of claim 1, wherein the plurality of movable spring seats are configured for vertical linear movement.

8. The vehicle suspension system of claim 1, wherein the electromechanical actuator comprises a geared motor connected to the plurality of movable spring seats with actuating beams, wherein pivoting movement of the actuating beams translate the movable spring seats.

9. The vehicle suspension system of claim 8, wherein the electromechanical actuator further comprises a power screw that converts rotational movement of the geared motor to translational movement of the plurality of movable spring seats to linearly adjust a length of the plurality of springs.

10. The vehicle suspension system of claim 8, further comprising a plunger connecting the plurality of spring seats to the plurality of actuating beams.

11. The vehicle suspension system of claim 10, wherein the pivoting movement one of pushes and pulls the plunger.

12. The vehicle suspension system of claim 8, wherein the electromechanical actuator further comprises a guiding slot with end stops to maintain the plurality of movable spring seats along a linear path between the end stops.

13. A vehicle system, comprising:

a frame configured to receive a plurality of axles, each of the axles having a corresponding spring suspension system with a plurality of springs;

a traction motor coupled to at least some of the plurality of axles;

a plurality of movable spring seats configured to adjust a length of the plurality of springs to change a preloading of the springs;

an electromechanical actuator connected to the plurality of movable springs and configured to move the spring seats to adjust the length of the plurality of springs, wherein the electromechanical actuator comprises power screws configured to translate the plurality of movable spring seats;

a spring cap coupled to the power screws and forming the movable spring seats; and a controller coupled to the electromechanical actuator to control the electromechanical actuator to adjust the length of the plurality of springs.

14. The vehicle system of claim 13, wherein the controller dynamically adjusts the length of the plurality of springs based on operating conditions.

15. The vehicle system of claim 13, wherein the traction motors are coupled only to outer axles and the electromechanical actuator is coupled within an opening inside of the frame in connection with a center axle.

16. The vehicle system of claim 13, wherein the electromechanical actuator is coupled to an outside of the frame to an axle box.

17. The vehicle system of claim 13, wherein the electromechanical actuator further comprises a geared electric motor and rotational movement of the geared electrical motor is translated to linear movement of the movable spring seats.

18. A method for dynamically redistributing weight in a vehicle, the method comprising:

configuring a plurality of springs of a vehicle suspension for variable preloading;

mounting a preloading mechanism with the plurality of springs to the vehicle, the preloading mechanism having an electromechanical actuator comprising power screws;

coupling a spring cap to the power screws for forming a plurality of movable spring seats;

configuring the movable spring seats for adjusting a length of the plurality of springs;

operating the power screws for translating the plurality of movable spring seats; and controlling the length of the plurality of springs to provide variable spring preloading and load redistribution among axles of the vehicle.

19. The method of claim 18, further comprising controlling the spring length based on operating conditions using a control module.

20. The method of claim 18, further comprising controlling the length of the springs in a center suspension connected to a center axle not having a traction motor and wherein outer suspensions connected to outer axles include traction motors.

* * * * *